United States Patent [19]

Jordan et al.

[11] Patent Number: 5,022,245

[45] Date of Patent: Jun. 11, 1991

[54] LOCKING DEVICE FOR SLIDING DOORS AND THE LIKE

[76] Inventors: William D. Jordan; Deborah A. Jordan, both of 7121 Honey La., St. Louis, Mo. 63129

[21] Appl. No.: 484,265

[22] Filed: Feb. 26, 1990

[51] Int. Cl.[5] ..... E05B 65/00

[52] U.S. Cl. ..... 70/94; 292/DIG. 46

[58] Field of Search ..... 70/94, 95, 19; 292/259 R, 338, 339, DIG. 46, 262, 258

[56] References Cited

U.S. PATENT DOCUMENTS

| | | | |
|---|---|---|---|
| 212,242 | 2/1879 | Loper | 292/259 |
| 698,326 | 4/1902 | Schwab | 292/259 X |
| 896,149 | 8/1908 | Piquotte | 292/DIG. 46 X |
| 1,304,394 | 5/1919 | Sayer | 292/338 |
| 3,698,754 | 10/1972 | Means | 292/DIG. 46 X |
| 4,135,376 | 1/1979 | Evans et al. | 292/DIG. 46 X |
| 4,314,721 | 2/1982 | Clark | 292/DIG. 46 X |
| 4,413,852 | 11/1983 | Burnell et al. | 292/259 |
| 4,500,123 | 2/1985 | Harms | 292/259 |
| 4,601,503 | 7/1986 | Wicks, Sr. | 292/259 |
| 4,779,910 | 10/1988 | Dameron | 292/259 |

*Primary Examiner*—Gary L. Smith
*Assistant Examiner*—Suzanne L. Dino

[57] ABSTRACT

A lock device for locking a sliding member relative to a stationary member, the sliding and stationary members including frames, the device includes a bracket for attaching to the frame of the sliding member. The bracket includes a first member secured to the bracket and a second member rotatably connected to the first member. The second member includes a locking mechanism for securing the second member to the first member. A bar member is also included and has one end adapted to be supported by the first member and to be secured in place by the second member when the locking mechanism secures the second member to the first member. The bar member extends outwardly from the bracket to the frame of the stationary member to prevent sliding movement of the sliding member.

14 Claims, 2 Drawing Sheets

LOCKING DEVICE FOR SLIDING DOORS AND THE LIKE

BACKGROUND OF THE INVENTION

The present invention relates to a lock device and more particularly to a lock and stop mechanisum for preventing sliding movement of a sliding panel such as a sliding door, window, and the like.

Sliding glass doors or windows typically have a lock which secures the sliding door or window to a frame structure. These locks are easy to manipulate and do not allow an acceptable level of security. In order to further secure sliding doors and windows, a wooden rod has been placed between the frame of the sliding member and the frame of the stationary member. However, the wooden rod may be easily removed by shaking or tilting the sliding member. Various other lock devices have been used to prevent unauthorized sliding movement of the sliding member. Examples of such structures are disclosed in U.S. Pat. Nos. 4,148,508 and 4,304,429. However, some of these prior art devices were of complicated construction, and were expensive and difficult to use.

SUMMARY OF THE INVENTION

Among the objects of the present invention is the provision of a lock device which is of simple structure and is relatively economical to manufacture and use; the provision of such a lock device which is of simple construction for low cost and highly reliable operation; the provision of such a lock device which can be easily installed on new and existing sliding doors and windows; and the provision of such a lock device which can be used to easily and quickly lock a sliding door or window.

Generally, a locking device for locking a sliding member relative to a stationary member, the sliding and stationary members including frames, includes a bracket for attaching to the frame of the sliding member. The bracket includes a first member attached to the bracket, a second member rotatably connected to the first member, and means for securing the second member to the first member. The locking device also includes a bar member having one adapted to be supported by the first member and to be secured in place by second member when the securing means secures the second member to the first member. The bar member extends outwardly from the bracket to the frame of the stationary member to prevent sliding movement of the sliding member.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
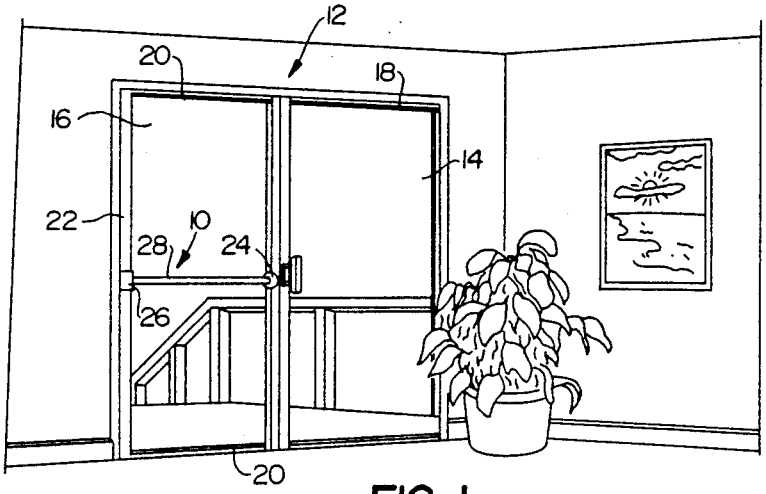
FIG. 1 is a perspective view of a lock device of the present invention installed on a sliding door.

A lock device of the present invention, indicated generally as 10 the figures, is shown as it would be installed on a sliding door 12. Referring to FIG. 1, the sliding door 12 includes a sliding member 14 and a stationary member 16. The sliding member 14 has a frame 18 which slides in tracks 20, as is conventionally known. The stationary member 16 also has a frame 22. The lock device 10 includes a bracket 24, a second bracket 26, and a bar member 28.

Figure 2:
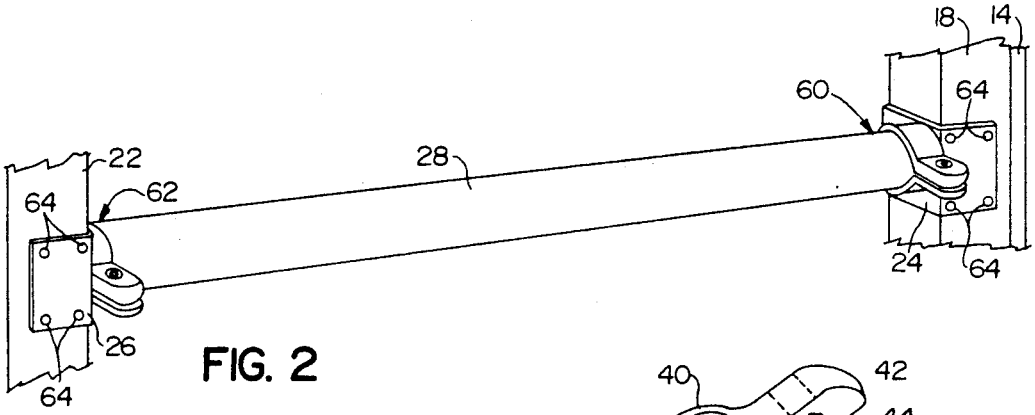
FIG. 2 is an enlarged perspective view of the lock device shown in FIG. 1.

FIG. 2 shows that the bracket 24 is attached to the frame 18 of the sliding member 14. The second bracket 26 is attached to the frame 22. The bar member 28 extends between the brackets 24 and 26 and prevents sliding movement of the sliding member 14 when in place.

Figure 3:
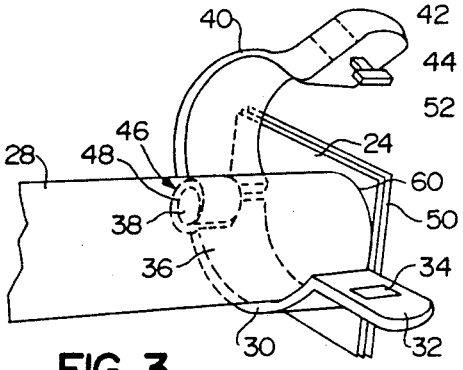
FIG. 3 is a perspective view of the lock device shown in the open position.

Referring now to FIG. 3, the bracket 24 is shown in the open position. The bracket 24 includes a first member 30 which is secured to the bracket 24. The first member 30 is generally U-shaped and includes a first end 32 having an aperture 34. The first member 30 has a second end 36 which includes a pin 38. The bracket 24 further includes a second member 40 which is generally U-shaped. The second member 40 has a first end 42 which includes a locking mechanism 44. The second member 40 has a second end 46 which is circular in shape and includes a bore 48 which is adapted to receive the pin 38. The second member 40 is rotatably connected to the first member 30. The bar member 28 is supported by the first member 30 and secured in place by the second member 40 when the second member 40 is secured to the first member 30 by the locking mechanism 44. Additionally, as shown in FIG. 3, the bracket 24 is secured to the frame 18 by using a double face adhesive pad 50.

The lock mechanism 44 includes a tab 52 which is sized to fit through the aperture 34. Once the tab 52 is inserted through the aperture 34 it is rotated to secure the second member 40 to the first member 30.

Figure 4:
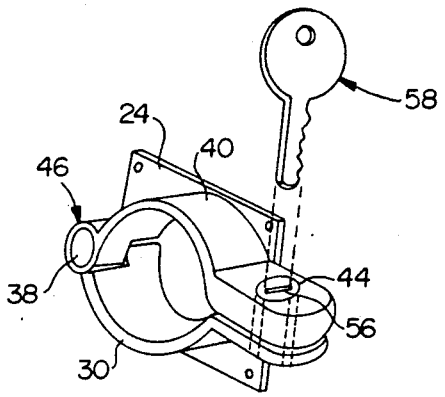
FIG. 4 is perspective view of the lock device shown in the closed position.

FIG. 4 illustrates the bracket 24 in the closed position. The locking mechanism 44 is shown to include a key operated lock 56 for operating the locking mechanism 44 to rotate the tab 52. A key 58 may be used to operate the lock 56 or a chuck key or allen wrench may also be used. The bracket 24 may also include screw holes 54 for mounting the bracket 24 directly to the frame 18.

In operation, the sliding member 14 is in its closed position. The second member 40 is unlocked and rotated away from the first member 30. A first end 60 of the bar member 28 is placed on the first member 30 and held in place until the second member 40 is rotated towards the first member 30 and the locking mechanism 44 is locked. Additionally, as shown in FIG. 2, the second bracket 26 may be used to lock a second end 62 of the bar member 28 in place. The second bracket 26 is similar in design and contruction to the bracket 24. Also, the brackets 24 and 26 may be L-shaped and secured to the frames 18 and 22, respectively, by using screws 64.

Figure 5:
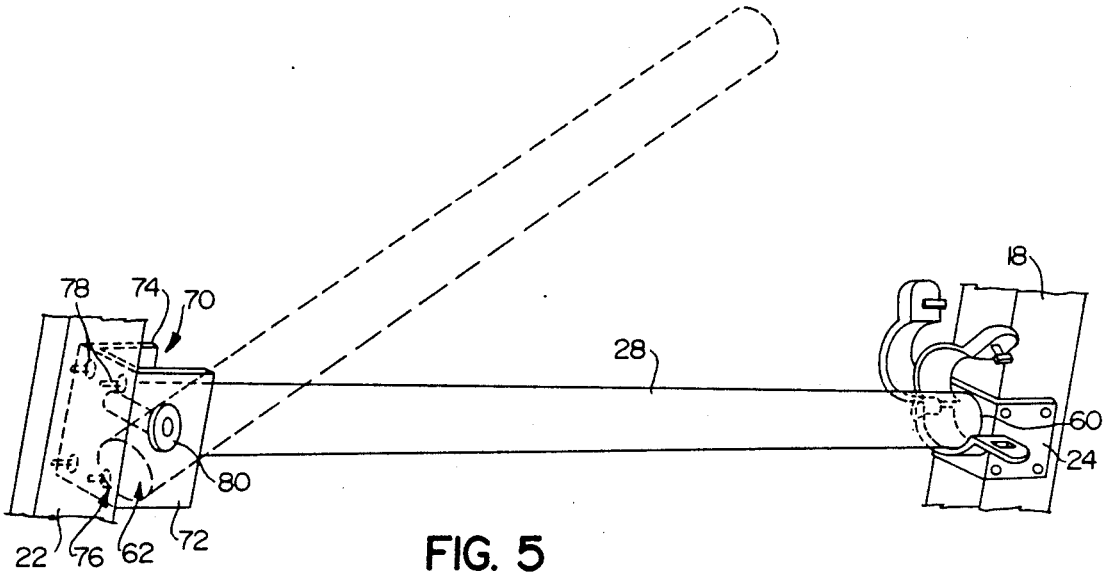
FIG. 5 is a second embodiment of the lock device of the present invention installed on a sliding door.

Referring now to FIG. 5, there is illustrated a modified second bracket 70. The modified second bracket 70 is a generally U-shaped bracket having two ends 72 and 74 connected to an intermediate portion 76. The intermediate portion 76 is secured to the frame 22 by using screws 78. The end 72 includes a pivot pin 80 which is inserted through the second end 62 of the bar member 28. The bar member 28 may be pivoted into place to secure the first end 60 in the bracket 24.

In view of the above, it will be seen that the several objects of the invention are achieved and other advantageous results attained.

As various changes could be made in the above constructive without departing from the scope of the invention, it is intended that all matter contained in the above description or shown in the accompanying drawings shall be interpreted as illustrative and not in a limiting sense.

What is claimed is:

1. A lock device for locking a sliding member relative to a stationary member, the sliding members including frames, the device comprising:

a bracket for attaching to the frame of the sliding member, the bracket including a first member secured to the bracket and a second member rotatably connected to the first member, and means for securing the second member to the first member, wherein the first member is generally U-shaped having a first end including an aperture and a second end including a pin; and a bar member having one end adapted to be supported by the first member and to be secured in place by the second member when the securing means secures the second member to the first member, the bar member extending outwardly from the bracket to the frame of the stationary member to prevent sliding movement of the sliding member.

2. The lock device of claim 1 wherein the securing means comprises a key operated locking mechanism.

3. The lock device of claim 2 wherein the locking mechanism includes a tab which is rotated by the key operated locking mechanism.

4. The lock device of claim 1 further comprising a second bracket for attaching to the frame of the stationary member, the second bracket including a first member secured to the second bracket and a second member rotatably connected to the first member of the second bracket, and means for securing the second member of the second bracket to the first member of the second bracket.

5. The lock device of claim 4 wherein the first member of the second bracket is generally U-shaped having a first end including an aperture and a second end including a pin.

6. The lock device of claim 5 wherein the second member of the second bracket is generally U-shaped having an end including a locking mechanism adapted to lock the second member of the second bracket to the first member of the second bracket and an other end rotatably connected to the pin.

7. The lock device of claim 6 wherein the other end of the second member is circular in shape including a bore which receives the pin.

8. The lock device of claim 1 further comprising a second bracket for attaching to the frame of the stationary member, the second bracket including a first end and a second end, each of the ends being connected to an intermediate portion, the intermediate portion connected to the frame of the stationary member, and a pivot pin which is inserted through the second end and the other end of the bar member.

9. The lock device of claim 1 wherein the bracket is secured to the frame of the sliding member by screws.

10. The lock device of claim 1 wherein the bracket is secured to the frame of the sliding member by a double faced adhesive pad.

11. The lock device of claim 1 wherein the sliding member is a sliding door and the stationary member is a stationary door.

12. The lock device of claim 1 wherein the sliding member is a sliding window and the stationary member is a stationary window.

13. The lock device of claim 1 wherein the second member is generally U-shaped having a first end including a locking mechanism adapted to lock the second member to the first member and the second member including a second end rotatably connected to the pin.

14. The lock device of claim 13 wherein the second end of the second member is circular in shape including a bore which receives the pin.

* * * * *